United States Patent [19]

Freitag

[11] 4,018,495

[45] Apr. 19, 1977

[54] CONNECTOR DEVICE

[75] Inventor: Walter O. Freitag, Dresher, Pa.

[73] Assignee: Sperry Rand Corporation, New York, N.Y.

[22] Filed: Oct. 2, 1975

[21] Appl. No.: 618,867

[52] U.S. Cl. ..... 339/17 L; 339/75 MP

[51] Int. Cl.[2] ..... H01R 13/26

[58] Field of Search ..... 339/17 L, 74, 75, 176 MP, 339/91 R

[56] References Cited

UNITED STATES PATENTS

| | | | |
|---|---|---|---|
| 3,140,907 | 7/1964 | Davies | 339/17 L |
| 3,439,227 | 4/1969 | Gifford | 339/91 R |
| 3,464,054 | 8/1969 | Mansfield | 339/176 MP |
| 3,585,573 | 6/1971 | Robshaw | 339/176 MP |
| 3,858,957 | 1/1975 | Harwood et al. | 339/176 MP |

*Primary Examiner*—Roy Lake
*Assistant Examiner*—Neil Abrams
*Attorney, Agent, or Firm*—Rene A. Kuypers

[57] ABSTRACT

The invention discloses a connector having a contact means which does not gouge the metallization of a printed circuit card when an ohmic connection is made. The connection is obtained by guiding the contact over the metallization until it is properly located after which it is snapped into position. An ohmic connection is thereby made between the printed circuit card and the connector.

8 Claims, 4 Drawing Figures

Fig. 1
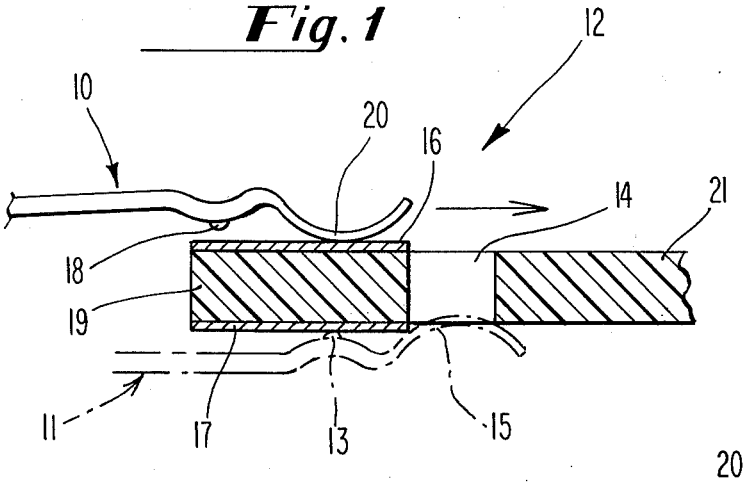
Fig. 1a
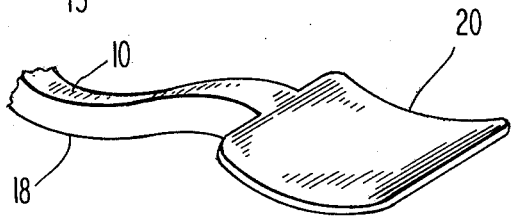
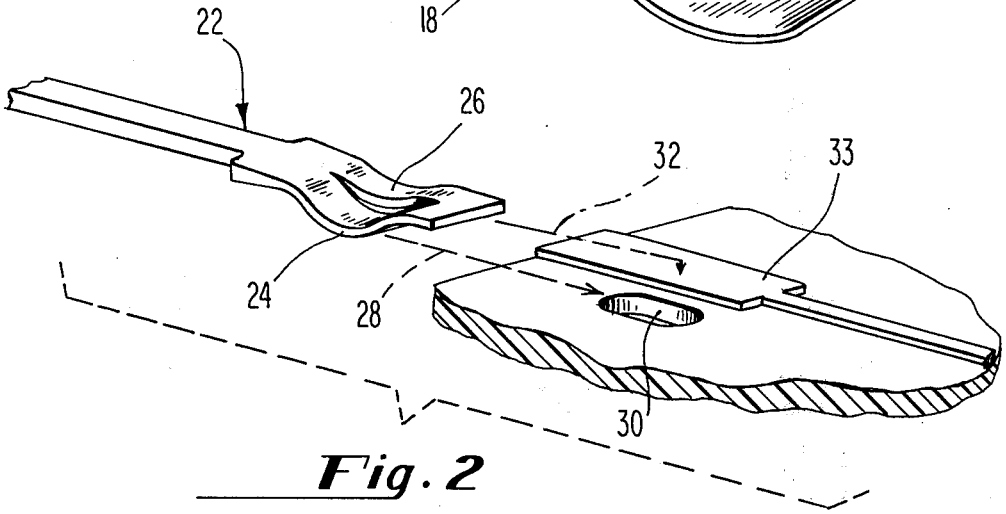
Fig. 2
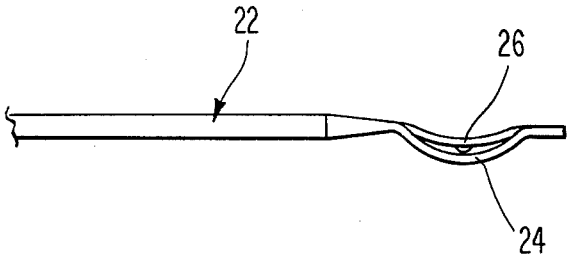
Fig. 2a

CONNECTOR DEVICE

BACKGROUND OF THE INVENTION

1. Field of the Invention

This invention relates to the field of connectors and in particular to the field of wiping and non-wiping type of card edge connectors.

2. Description of the Prior Art

In the known prior art type of connector which utilize a spring loaded contact to make an ohmic connection with the metallization fingers of a printed circuit card, considerable damage in the form of gouging occurs over many removals and insertions of the card. The gouging is caused by the contact sliding over the metal fingers thereby wearing the metal and forming grooves therein. Eventually there may be a loss of the ohmic connection, which is time consuming and expensive to locate in modern day complex electronic devices.

Numerous designs are known wherein the tension of the spring which holds the contact may be taken up by auxiliary members such as levers or cams. In this type of connector, known as a zero insertion force connector, the printed circuit card is inserted while the contacts are held back by the auxiliary member. After the card is in place the full tension of the spring is allowed to fall back on the contact and effect the ohmic connection. Such auxiliary members add to the cost of the connector and have the additional disadvantage that space must be provided for mechanical access to the actuating mechanism. This requirement for access space prevents the close stacking of connectors which is necessary for electronic assemblies requiring the use of many printed circuit cards.

SUMMARY OF THE INVENTION

The invention provides one type connector that is an economical alternative to a "zero insertion force" connector by combining the non-wiping feature of the zero force connector and the low cost of a regular connector. The connector of this invention has been designed so that the contact clears the metal finger surface during insertion so that there is no damage to the metallization circuit.

The invention discloses a second type connector which minimizes the wiping damage as the contact is positioned for an ohmic connection with the metallization circuit.

It is therefore an object of this invention to provide an economical contact connector that has the non-damaging characteristics of the "zero insertion force" type of connector.

BRIEF DESCRIPTION OF THE DRAWING

FIG. 1 and 1*a* depicts an embodiment of the invention wherein a minimal wiping damage connector is shown during the insertion of a card and after it is seated.

FIGS. 2 and 2*a* depict the preferred embodiment of the invention which incorporates a non-wiping feature of the connector.

DESCRIPTION OF THE PREFERRED EMBODIMENTS

Referring now in greater detail to FIG. 1, the connector arrangement 12 of this invention is shown both on the upper and underside of the substrate 19. The connector on the upper side of the substrate 19 represents the condition during insertion of a card into the connector 10, whereas the connector 11 on the underside of the substrate 19 depicts the condition wherein the card is fully seated with connector 11. The connector device 12 is comprised essentially of connectors 10, 11, which are formed of beryllium copper, phosphor bronze or similar metal having spring-like properties. Integrally formed with the connector 10, for example, is the rider 20 and a contact 18. The rider 20 is broad and curved in shape. It is approximately 2–3 times as broad as the body of the connector 10. For example, the body 10 has a square cross section of 25 mils. The rider 20 is approximately 50–75 mils in width. The contact 18 and the rider 20 are arranged on the connector body 10 so that they are located at different height levels. The reason for these different height levels will be discussed in greater detail in later paragraphs.

Cooperating with the connector 10 is the printed circuit card 21, only a portion of which is shown. The printed circuit card 21 shows a metallization finger 16 formed on the substrate 19 as is well known in the art. At the end of the metallization finger 16 a hole 14 is formed in the substrate 19. The function of the hole 19 will also be described in a later paragraph. The connectors 10, 11 are supported in a housing (not shown) in such a way that they are deflected from their rest position by the insertion of the printed circuit card 21.

The under side of the printed circuit board 21 depicts the connector 11 which is shown in phantom to distinguish it from the connector 10. The connector 11 is shown in the fully seated position, since the rider 15 is positioned in the hole 14 and the contact 13 provides an ohmic connection between the connector 11 and the metallization finger 17. As those skilled in the art will appreciate, the metallization finger 17 will be connected to some electrical circuit on the printed circuit card 21, whereas the end of the connector 11 is connected to another circuit (not shown). The end of the connector 11 is conventionally connected to a circuit, which is part of the chassis. Therefore, an ohmic connection is obtained between a circuit connected to the metallization 17 and a circuit made to connector 11.

In operation the printed circuit card 21 is removable, whereas the connectors 10 and 11 are stationary and form part of the electronic chassis of a computer, TV set or other such device. The printed circuit card 21 is inserted and removed frequently because the components that are located thereon (not shown) often times break down and it is necessary to replace the board or test it, as the case may be. In the prior art type of connector, the frequent insertion and extraction of the printed circuit board 21 causes the contacts 13 and 18 to develop a gouge in the respective metallization fingers 17 and 16. The gouging of the metallization by the contacts 13 and 18 may cause a possible loss of the ohmic connection that is desired between the printed circuit card 21 and the connectors 10, 11.

When the printed circuit card 21 is inserted by moving from right to left in the drawing the rider 20, which is at a lower height level than that of contact 18, will ride on the metallization 16. The contact 18 is thereby lifted over the metallization 16. The area of contact between rider 20 and finger 16 extends approximately the full width of the finger thereby distributing the spring force of connector 10 over the full width of the finger. As a consequence of distributing the connector 10 force over a large area of the metallization, the wiping damage caused by the rider 20 to the metallization 16 during insertion is minimal. In this manner, there is no scratching or gouging of the metallization 16 by the contact 18 during the insertion process. The contact 18 is designed to clear the metallization by approximately one mil or more.

As the printed circuit board 21 is further inserted into position and extends further to the left, the rider 20 eventually reaches a position over the hole 14. This is shown with particularity by means of the lower connector 11 shown in phantom. When the rider falls into the hole 14 the contact 13 is urged against the metallization 17 with some force. This arrangement produces several noteworthy results. One result is that a good ohmic connection is obtained between the contact 13 and the metallization 17. Another beneficial result that is obtained from this arrangement is that when the printed circuit card 21 is fully in position and riders 20 and 15 are both located in hole 14, the force exerted by each contact 18 and 13 against the respective metallization fingers 16 and 17 will cause the printed circuit card 21 to remain firmly in position and will prevent any movement thereof. The force exerted by each rider 15, 20 against the hole 14 also prevents any lateral movement as well as aiding in maintaining the card 21 in position. It should be appreciated that only two connectors 10 and 11 are shown exerting forces on either side of the printed circuit card 21. However, in actual practice there would be many such connector bodies on either side of the printed circuit card so that the forces of each connector would be exerted along both sides of the edge of the printed circuit card to maintain it firmly in position.

FIG. 2 shows the preferred embodiment of the invention. In this embodiment, the rider 24 and the contact 26 are formed on opposite sides of a perforation. The perforation is located near the terminal end of the connector 22. The rider 24 is formed on one side of the perforation and the contact 26 is formed on the other side thereof. As previously described with respect to the first embodiment, the connector 22 may be made of either beryllium copper or phosphor bronze or other suitable metal. Also, referring to FIG. 2*a*, it can be seen that the rider 24 is at a lower level than is the contact 26.

As the connector 22 is brought into position with respect to the metal finger 33, the rider 24 follows the path 28 to the hole 30 which is formed in the substrate material of the printed circuit card. As the rider 24 follows the path 28 on the substrate it lifts the contact 26 over the metal finger 33 so that the latter is not touched. When the rider 24 reaches the hole 30, it is designed to fit into the hole 30 so that the connector 22 is lowered and the contact 26 makes an ohmic connection with the metallization finger 33. It should be noted again that the connector 22 is fabricated in such a manner that when the rider 24 reaches the hole 30 the contact 26 impinges on the metallization finger 33 with some force so that a good ohmic connection is made which cannot be broken by vibration or unaccounted for movement of the chassis to which it is attached.

A recognized advantage of this embodiment is that the rider 24 wipes over the exposed face of the substrate next to the metallization finger 33. Consequently, the rider 24 never touches the finger 33 whereby any possibility of wiping damage is eliminated.

It will be appreciated by those skilled in the art that the holes 14, 30 discussed in FIGS. 1 and 2 might also be a depression formed in the substrate. Similarly, the contact can be a contact dot of any well-known shape such as a sphere, wedge or dimple.

I claim:

1. An electrical connector device for making a non-slidable ohmic connection with a metal finger of a printed circuit card comprising:

a. an integrally formed member having a slender arm and wider end appendage, b. a contact means formed on said appendage at a fixed longitudinal distance from its free terminal end, c. slide means further formed on said appendage at approximately said fixed distance from said free terminal end, and immediately lateral to said contact means, said contact means and said slide means extending at different levels in a direction toward said printed circuit, d. means formed in said printed circuit card for receiving said slide means, e. said integrally formed member slidably engaging said printed circuit card via said slide means such that said contact means does not meet said metal finger until said slide means reaches said receiving means in said printed circuit, said contact means thereby making said non-slidable ohmic connection with said metal finger.

2. The connector device in accordance with claim 1 wherein said appendage incorporates means for separating said contact means and said slide means, said means being integrally formed with said appendage.

3. The connector device in accordance with claim 2 wherein said separating means comprises a slit means, said slit means forming one side of said slide means.

4. The connector device in accordance with claim 1 wherein said appendage is rectangular in shape.

5. The connector device in accordance with claim 1 wherein said receiving means comprises a slot formed in the printed circuit.

6. An arrangement in accordance with claim 1 wherein said contact means is made of beryllium copper.

7. An arrangement in accordance with claim 1 wherein said contact means is made of phosphor bronze.

8. An electrical connector device for making a non-slidable ohmic contact with a metal finger of a printed circuit card comprising:

a. a spring-like member having a longitudinal and transverse dimension, said longitudinal dimension being greater than said transverse dimension, b. an extension integrally formed at one end of said spring-like member along its longitudinal axis, said extension having a wider transverse dimension than said first mentioned transverse dimension, c. a contact member for touching said metal fingers formed on said extension at a fixed distance from its terminal free end, d. slide means formed on said extension on the same side and laterally disposed to said contact member at approximately said fixed distance from said terminal free end, and wherein said last mentioned means and said contact member extend downwardly at different levels towards said printed circuit card, said slide means being at a lower level than said contact member, e. means formed in said printed circuit card for receiving said slide means such that said spring-like member engages said printed circuit card via said slide means, and said contact member making said non-slidable ohmic connection with said metal finger when said slide means reaches said receiving means.

* * * * *